United States Patent [19]

Blacker et al.

[11] Patent Number: 4,771,216

[45] Date of Patent: Sep. 13, 1988

[54] ELECTRON GUN SYSTEM PROVIDING FOR CONTROL OF CONVERGENCE, ASTIGMATISM AND FOCUS WITH A SINGLE DYNAMIC SIGNAL

[75] Inventors: Allen P. Blacker; Khem K. S. Garewal, both of Hoffman Estates, Ill.

[73] Assignee: Zenith Electronics Corporation, Glenview, Ill.

[21] Appl. No.: 85,901

[22] Filed: Aug. 13, 1987

[51] Int. Cl.[4] ..... H01J 29/58

[52] U.S. Cl. ..... 315/382; 315/368; 315/15

[58] Field of Search ..... 315/368, 382, 371, 14, 315/15; 313/428, 414, 449

[56] References Cited

U.S. PATENT DOCUMENTS

| | | |
|---|---|---|
| 2,801,363 | 7/1957 | Sonnenfeldt . |
| 2,957,106 | 10/1960 | Moodey . |
| 3,412,281 | 11/1968 | Richards, Jr. et al. . |
| 3,448,316 | 6/1969 | Yoshida et al. . |
| 3,772,554 | 11/1973 | Hughes . |
| 3,952,224 | 4/1976 | Evans, Jr. . |
| 4,058,753 | 11/1977 | Blacker et al. . |
| 4,234,814 | 11/1980 | Chen et al. . |
| 4,242,613 | 12/1980 | Brambring et al. . |
| 4,319,163 | 3/1982 | Chen . |
| 4,334,169 | 6/1982 | Takenaka et al. . |
| 4,366,414 | 12/1982 | Hatayama et al. . |
| 4,473,775 | 9/1984 | Hosokoshi et al. . |
| 4,513,222 | 4/1985 | Chen . |
| 4,520,292 | 5/1985 | van Hekken et al. . |
| 4,523,123 | 6/1985 | Chen . |
| 4,629,933 | 12/1986 | Bijma et al. . |
| 4,641,058 | 2/1987 | Koshigoe et al. . |
| 4,704,565 | 11/1987 | Blacker, Jr. et al. ..... 315/382 |

OTHER PUBLICATIONS

Progressive-Scanned 33-In. 110 Degrees Flat-Square Color CRT Suzuki et al., SID 87 Digest, pp. 166-169.

*Primary Examiner*—Theodore M. Blum

[57] ABSTRACT

A color cathode ray tube system is disclosed that has a color tube with a phosphor screend. The system includes yoke means for deflecting the beams while introducing a beam-astigmatizing quadrupole field. A three-beam, in-line electron gun includes cathode means for developing the beams, and three focus lens means for receiving the electron beams and forming three focused electron beam spots at the screen of the tube. The focus lens means each has a plurality of electrode means spaced along a lens axis parallel to the other lens axes and parallel to a gun central axis, at least two of which lens axes are off-axis with respect to the gun central axis. Electrostatic quadrupole-developing means are so configured and arranged as to develop a quadrupole field in the path of each of the beams when appropriately excited, and convergence means are effective to converge the off-axis beams when appropriately excited. System signal generating means provide for developing a signal having amplitude variations correlated with a scan of the beams across the screen and for applying the signal to at least one of the electrode means, to the convergence means, and to the quadrupole-developing means to simultaneously cause, as a function of beam deflection angle, (1) the strength of the one or more focusing field components to weaken to produce a dynamic focusing effect, (2) the strength of the asymmetrical field component affecting the off-axis beams to weaken to produce a dynamic convergence effect, and (3), the strength of the quadrupole field to increase to produce a dynamic astigmatism-correction effect to compensate for the beam-astigmatizing effect of the yoke. The gun system according to the invention provides control of convergence, astigmatism and focus with a single dynamic signal.

25 Claims, 6 Drawing Sheets

ELECTRON GUN SYSTEM PROVIDING FOR CONTROL OF CONVERGENCE, ASTIGMATISM AND FOCUS WITH A SINGLE DYNAMIC SIGNAL

CROSS-REFERENCE TO RELATED APPLICATIONS AND PATENTS

This application is related to but in no way dependent upon copending applications Ser. Nos. 832,493 filed Feb. 21, 1986; 832,568 filed Feb. 21, 1986; 921,168 filed Oct. 26, 1986; and U.S. Pat. Nos. 2,957,106; 3,995,194; 4,058,753; 4,344,170, all of common ownership herewith.

This specification includes an account of the background of the invention, a description of the the best mode presently contemplated for carrying out the invention, and appended claims.

BACKGROUND OF THE INVENTION

1. Field of the Invention

This invention relates to color cathode ray picture tubes, and is addressed specifically to a color cathode ray tube system having an improved unitized, three-beam, in-line electron gun. The system and associated electron gun according to the invention have application to all types of color television picture tubes, including those used in home entertainment television receivers. The system is especially valuable when applied to special-purpose high-resolution color image tubes that require beam spots that are exceptionally small in diameter, uniorm in size, and symmetrical all over the screen. Tubes of this type include medium-resolution and high-resolution monitors. An example of such a special-purpose tube is one that has a flat faceplate and an associated foil tension mask; a tube of this type is described and claimed in referent copending application Ser. No. 832,493 of common ownership herewith.

Desired performance characte-ristics of color cathode ray tube systems include high resolution, picture brightness, and color purity. Resolution is largely a function of the size and symmetry of the beam spots projected by the electron gun of the tube. Beam spots are desirably small, round, and uniform in size at all points of landing on the screen. Achievement of these ideals is difficult because of the many factors which exert an influence on beam spot configuration. As a result of such factors, beam spots that are small and symmetrical at the center of the picture imaging field can become distorted at the periphery of the field, for reason which will be described.

Key factors which influence beam spot size, uniformity and symmetry in picture tubes include the following:

(a) electron gun design, especially the design of the means for focusing and converging the beams in three-beam, in-line guns;

(b) potential of the cathode ray tube screen;

(c) magnitude of the beam current;

(d) the "throw" distance from the electron gun to the screen; and, (e) the magnitude of beam-distorting influences, such as astigmatism engendered by a self-converging yoke, or that inherent in the gun design.

The ability of an electron gun to form small, symmetrical beam spots is a major factor in achieving optimum resolution. The task of designing guns with this capability has become more challenging because of the reduction in diameter of the CRT neck. This physical constraint has been largely overcome by new, more effective gun designs, such as the gun having an extended field main focus lens described and claimed in U.S. Pat. No. 3,995,194 assigned to the assignee of this invention.

Convergence of the three beams of an in-line electron gun is provided in present-day television systems primarily by the self-converging yoke. This type of yoke is a hybrid having toroidal-type vertical deflection coils and saddle-type horizontal deflection coils. The yoke contains windings which produce an astigmatic field component that has the effect of maintaining the beams in convergence as they are swept across the screen. The converging effect is shown highly schematically in FIG. 1, in which an electron gun 10 is depicted graphically as emitting three beams 12, 13 and 14 which diverge from a common plane 16 to impinge on a curved screen 18. The three beams are shown as being converged at the center point 20 of the screen 18. Due to the effect of the self-convrging yoke, the three beams are also caused to be in convergence at the side of the screen 18, as indicated by point 22, even though the distance that beams must travl from the plane of deflection 16 t point 22 is greater than from the plane of deflection 16 to center point 20 of the screen.

The convergence achieved is not without cost, however, as the beam spots are subject to distortion in the peripheral areas of the screen. The distortion is acceptable in conventional tubes that have the curved screen as the benefits and costs savings of the self-converging yoke outweigh its liabilities.

However, when the screen is flat, as indicated by screen 24 in FIG. 2, the self-converging yoke is unable to maintain beam convergence, as indicated by the spread of the beam spots 28 at the sides 26 of screen 24. In addition to the spread, the spots 28 will be noted as being elongated. This elongation is due primarily to the self-converging yoke. The astigmatic field component, while self-converging the beams, undesirably induces deflection defocusing of the beams when the beams are deflected away from the screen center. The effect is indicated diagrammatically in FIG. 3 by beam spots 34. The elongation of the beam spots at the peripheries of the faceplate, and the relative increase in spot size, is indicated in greater detail in FIG. 3A. The beam spots 34 will be seen as comprising a bright core 34A, and transverse to the core, a dim "halo," 34B. The size and contour of the center beam spot 36 is indicated to illustrate the magnitude of the spot size increase and distortion at the corners of the screen. Attempts to focus such beams are largely ineffectual due to the astigmatic effect—focusing merely results in what appears to be a "rotation" of the spot in that the core becomes the halo and the halo becomes the core, without restoration of center-screen dot contour and size.

The distortion of the beam spots at screen peripheries is attributable to the nature of the field of the yoke that provides the desired beam convergence. The field produced by the yoke has the shape of a pin-cushion for the horizontal deflection component, and the shape of a barrel for the vertical deflection component. In addition to the dipole effect which deflects the beams, a quadrupole, astigmatizing effect is also produced which distorts the beams at the screen peripheries, as indicated in FIGS. 3 and 3A.

As has been noted, the effect is tolerable in conventional tubes where the screen is curved, as shown by FIG. 1, and it is acceptably within the capability of the self-converging yoke to converge the beams without undue distortion. However, when the screen is flat, as indicated by FIG. 2, the astigmatic effect of the self-converging yoke is less tolerable, especially in high-resolution cathode ray tubes. Attempts to further modify the configuration of the self-converging yoke field to adapt it to a flat screen may well increase distortion outside the limits of acceptability. The self-converging abiity of the yoke was already stretched to its limit in its application to the curved screen, before the advent of the flat tension mask tube.

2. Prior Art

Prior art structures for statically converging electron beams have relied upon a variety of techniques such as the use of maghetic influences within and/or outside the tube envelope, and the use of electrostatically charged plates. Also, the prior art shows many examples of causing static beam convergence by inducing an asymmety in an electrostatic field formed at the interface of two spaced electrodes. Prior art techniques for inducing electrostatic field asymmetry have included offsetting the apertures in the opposing faces of two electrodes, and slanting one or more of the opposing faces so that the space lying between is in the form of a wedge-techniques described in U.S. Pat. No. 4,058,753 of common ownership herewith, and in U.S. Pat. No. 2,957,106.

Dynamic convergence means is described in U.S. Pat. No. 3,448,316. Three in-line electron beams generated by three cathodes cross over in the electrostatic field of a main lens. The center beam (green) follows a straight-line path, but the two outer "red" and "blue" beams exit the lens in divergent paths. The beams paths are refracted to converge by electron prisms that enclose the beams, and which are located beyond the exit-point of the beams from the gun. The potential on the outer ones of the electron prisms is made adjustable to provide for static convergence of the red and blue beams at the shadow mask. The center beam is unaffected as the potential on the two inner plates through which it passes is left unchanged. Dynamic convergence is attained by changing the convergence control voltage on the outer prisms at the horizontal scanning frequency. The waveform of the convergence voltage is in the form of a parabola.

In U.S. Pat. No. 4,520,292, von Hekken et al discloses means formed in the screen grid of an electron gun for urging the outer two beams of a three-beam electron gun into convergence with the center beam. The screen grid configuration includes a transversely disposed recessed portion having a substantially rectangular central portion and substantially triangular end parts. The total effect is to tilt the field lines within the reessed portion so that the outer beams converge.

In U.S. Pat. No. 4,058,753, of common ownership herewith, there is disclosed a three-beam electron gun for a color cathode ray tube having an extended field main focus lens means. The focus lens means has for each beam at least three electrodes including a focus electrode for receiving a variable potential for electrically adjusting the focus of the beam. In succession down-beam, there are at least two associated electrodes having potentials thereon which form in the gaps between adjacent electrodes significant main focus field components. To adjust beam focus, the strength of a first of these components is controlled by adjustment of the voltage received by the focus electrode. The strength of the second of the field components is relatively less than that of the first component. Each of the lens means is characterized by having addressing faces of the associated electrodes which define the second field component being so structured and disposed as to cause the second field component-to be asymmetrical and effective to significantly divert the beam from its path in convergence of the beams without any significant distortion of the beam, and substantially independently of any beam-focusing adjustments of the first field component. Electrode structures for producing asymmetric field components include a gap angled forwardly and outwardly, a wedge-shaped gap, and radially offset apertures.

An electron gun system providing beam convergence for use in a color CRT display system is disclosed in referent copending application Ser. No. 921,168. Means including cathode means develop three electron beams, two of which are off-axis with respect to a center axis of the gun. A plurality of electrodes means provide shaping and focusing and assist in the converging of the beams at the screen. Means are provided for developing and applying to the electrode means a pattern of potentials which form field components in the gaps therebetween; at least one of the electrode means receives a varying dynamic focusing voltage for dynamically focusing the beams as they are deflected across the screen. At least selected ones of the plurality of electrodes means for the off-axis beams are so structured and arranged as to cause a plurality of the field components to be asymmetric and effective to converge the off-axis beams. The strengths of the asymmetric field components vary in response to changes in the dynamic focus voltage. The asymmetric field components according to the invention have such polarity and strength, due to the structuring and arranging of the electrodes, and the application of the pattern of voltages, that a change in the levels of the dynamic focus voltage causes a change in the strength of each of the asymmetric field in a direction effective to additively deflect a common off-axis beam in a common angular direction so as to create a strong dependency of the convergence of the off-axis beams on variations in the focus voltage.

An electron gun according to the invention disclosed in copending application Ser. No. 832,568 comprises means including cathode means for developing an eletron beam. Main focus lens means provide for receiving the beam and forming a focused electron beam spot at the screen of the tube. The main focus lens means has a plurality of electrodes situated on a common axis. Means are provided for developing and applying to the electrodes potentials effective to form field components in the gaps between adjacent electrodes. The lens means is so structured and arranged as to cause at least one of the field components to be asymmetric and effective to significantly divert the beams from a straight-line path through a predetermined angle. Means for developing and applying a varying voltage to at least one of the electrodes causes the strength of the asymmetric field component, and thus the angle by which the beam is diverted, to vary.

Takenaka et al in U.S. Pat. No. 4,334,169 shows embodiments of an electron gun with a three-element main focus lens (G1, G2 and G3) and outer beam converging means at the field between the center electrode (G2) and the accelerating electrode (G3) of the main focus lens. The convergence means comprise offset apertures and apertures lying at an angle with respect to the gun axis to render the field between asymmetric. The G1 and G2 electrodes are electrically inked and receive the focusing voltage. An aperture electrode is located intermediate to G1 and G2 of the main focus lens and is electrically linked to the accelerating electrode of the prefocusing section. The object is stated to be the maintenance of the pre-established convergence of the outer beams, despite changes in the focusing voltage.

Other representative disclosures having electrode structures that influence beam convergence include:

U.S. Pat. No. 3,952,224 to Evans

U.S. Pat. No. 3,772,554 to Hughes

U.S. Pat. No. 4,473,775 to Hosokoshi et al

U.S. Pat. No. 4,513,222 to Chen

The performance of cathode ray tubes is also a function of the ability of the gun and associated systems to establish and maintain focus at all points on the screen. Conventional curved-screen, curved-mask tubes, because of the curvature of the screen, are able to attain tolerable focusing performance on all points on the screen with little or no dynamic focusing. However, tubes having a flat faceplate exacerbate the focusing problem particularly at the screen edges due to the lack of curvature of the screen. For high-performance flat-faced tubes, dynamic focusing of electron beams is very desirable.

Techniques for dynamically varying the focus of electron beams are well-known in the art. Dynamic focusing is used to cause a beam to be in focus at the sides of the picture imaging field as well as at the center of the field. The need for dynamic focusing arises from the aforedescribed accurate scanning of the beam with relation to the relatively planiform faceplate.

Dynamic focusing of a beam can be accomplished electronically by menns of a focus-control signal modulated at the scanning frequency, with the signal being applied to a suitable beam-focusing electrode. Dynamic focusing means is disclosed by Richard in U.S. Pat. No. 3,412,281. An A. C. control signal is employed which is proportional to the distortion due to defocusing inherent in tube faces, according to Richard. The A.C. control signal is converted into a D.C. control signal which may be added to the relatively high-level constant voltage of the tube focusing circuit. Another approach to dynamic focusing is disclosed by U.S. Pat. No. 2,801,363.

Three patents to Chen disclose astigmatism-forming electrode structures. In U.S. Pat. No. 4,234,814, a gun is described that has a screen grid with an aperture comprising a rectangular slot portion facing the control grid, and a circular portion facing away from the control grid. The slot portion of the apertures is said to create an astigmatic field that produces under-convergence of the beam in the vertical plane only to avoid and/or compensate for vertical flae distortion of the beam spot at off-center positions on the image screen. In U.S. Pat. No. 4,319,163 of Chen, a gun lower end is disclosed that includes a cathode, a control grid, a first screen grid electrode having a horizontally elongated rectangular aperture, and a second screen grid electrode having a circular aperture. In operation, the second screen grid is energized with a DC bias voltage and the control grid and first screen grid is energized with a DC bias superposed with a substantially parabolically shaped dynamic signal synchronized with either or both the horizontal and vertical deflection signals. It is stated that the astigmatic optics of the beam forming means varies in strength in phase with the beam scan so as to provide optimum correction for flare distortion of the beam. In a third Chen Patent, U.S. Pat. No. 4,523,123, an inline gun includes a plurality of electrodes including a cathode, a control grid, a screen grid and a main focus lens. The screen grid has a given thickness with a plurality of transverse slots formed therein. The sots have a depth less than the thickness of the screen grid. An aperture is formed in each of the slots. The outer slots are asymmetric with respect to the apertures therein and are displaced transversely toward the center aperture. The transverse slots in the screen grid are said to compensate for the vertical flare distortion of the beam spot at off-center positions on the screen, and the asymmetric location of the outer slots is said to reduce the horizontal convergence sensitivity of the outer beams with respect to focus voltage change.

Other representative disclosures having astigmator electrode structures in the lower end include U.S. Pat. Nos. 4,242,613 to Brambring et al; 4,366,414 to Hatayama et al; and 4,629,933 to Bijma et al. Koshigoe in U.S. Pat. No. 4,641,058 discloses means for forming an asymetrical lens in both the prefocusing lens and in the main focus lens.

An in-line gun (the "DAF" gun) that is said to provide dynamic astigmatism and focus correction is described in a journal article by Suzuki et al. The focus electrode of a bipotential-type gun is split into a lower section adjacent to prefocusing lens, and an upper section adjacent to an accelerating anode. The beam-passing apertures in the opposed faces of the two sections are rectangular—the apertures in the ower section are vertically oriented, and those in the upper section are transverse to those in the lower section. The focus voltage is applied to the lower section, and a combination of the focus voltage and a dynamic voltage that is caused to vary with the excursion of the beams across the screen, is applied to the upper section. When the dynamic voltage is increased from the level of the focusing voltage, an electric quadrupole field is produced between the lower section and the upper section which is alleged to counter the astigmatizing field of the self-converging yoke. The amount of counter-astigmatizing is a function of the location of the beams on the screen—the farther from center screen, the greater the counter-astigmatizing effect. The lens formed between the upper section and the accelerating anode is an OLF—'-'overlapping field" lens. The use of OLF lens in this gun configuration is said to provide a larger apparent lens diameter with consequent lower magnification of the beam spots at center screen. However, the influence of the OLF lens is inherently astigmatizing, which distorts the beams at the center. Nor does the DAF gun have any provision for dynamic convergence other than the self-converging yoke. ("Progressive-Scanned 33-in. 110° Flat-Square Color CRT." Suzuki et al. SID 87 Digest, pp 166–169.)

OBJECTS OF THE INVENTION

It is a general object of the invention to provide an improved electron gun system for color cathode ray tubes, especially those having a planar tension mask and flatscreen.

It is an object of the invention to provide means for reducing or completely eliminating the beam-distortive effect of astigmatism originating either in the gun or in the cathode ray tube system.

It is an object of the invention to provide an improved electron gun system that provides compensation for the beam distortion induced by the use of a self-converging yoke.

It is another object of the invention to provide means for reducing or completely eliminating the effects of astigmatism in bipotential-type electron guns.

It is a further object of the invention to provide means for reducing or completely eliminating the effects of astigmatism in guns having an extended field focus lens means.

It is yet another object of the invention to provide an electron gun system that enhances the symmetry of beam spots and substantially maintains center-screen size and symmetry in peripheral areas of the screen when the beams are converged primarily by a self-converging beam-deflection yoke.

It is a further object of the invention to provide both static and dynamic control of astigmatizing influences on beam size and symmetry.

It is another object of the invention to provide dynamic convergence as well as dynamic focusing in electron gun systems having dynamic focusing capability.

It is further object of the invention to provide in a color cathode ray tube with a self-converging yoke an electron gun system having dynamic focusing, the system having the property that in the process of providing the dynamic focusing, a measure of dynamic convergence is ttained sufficient to significantly reduce the self-convergence demands on the associated yoke.

It is yet another object of the invention tc, provide for control of convergence, astigmatism and focusing by means of a single dynamic control voltage.

BRIEF DESCRIPTION OF THE DRAWINGS

The features of the present invention which are believed to be novel are set forth with particularity in the appended claims. The invention, together, with further objects and advantages thereof, may best be understood by referece to the following description taken in conjunctipn with the accompanying drawings, in the several figures of which like reference numerals identify like elements, and in which:

DESCRIPTION OF THE PREFERRED EMBODIMENT

The present invention can be applied to electron gun systems of several different types, both unitized and nonunitized. However, the illustrated embodiments according to the invention are in the form of in-line unitized guns as these types are in more general use in color cathode ray tube. The convergence means according to the invention is applicable to color tubes of various types including home entertainment television tubes, and to medium-resolution and high-resolution tubes used in color monitors.

Figure 4:
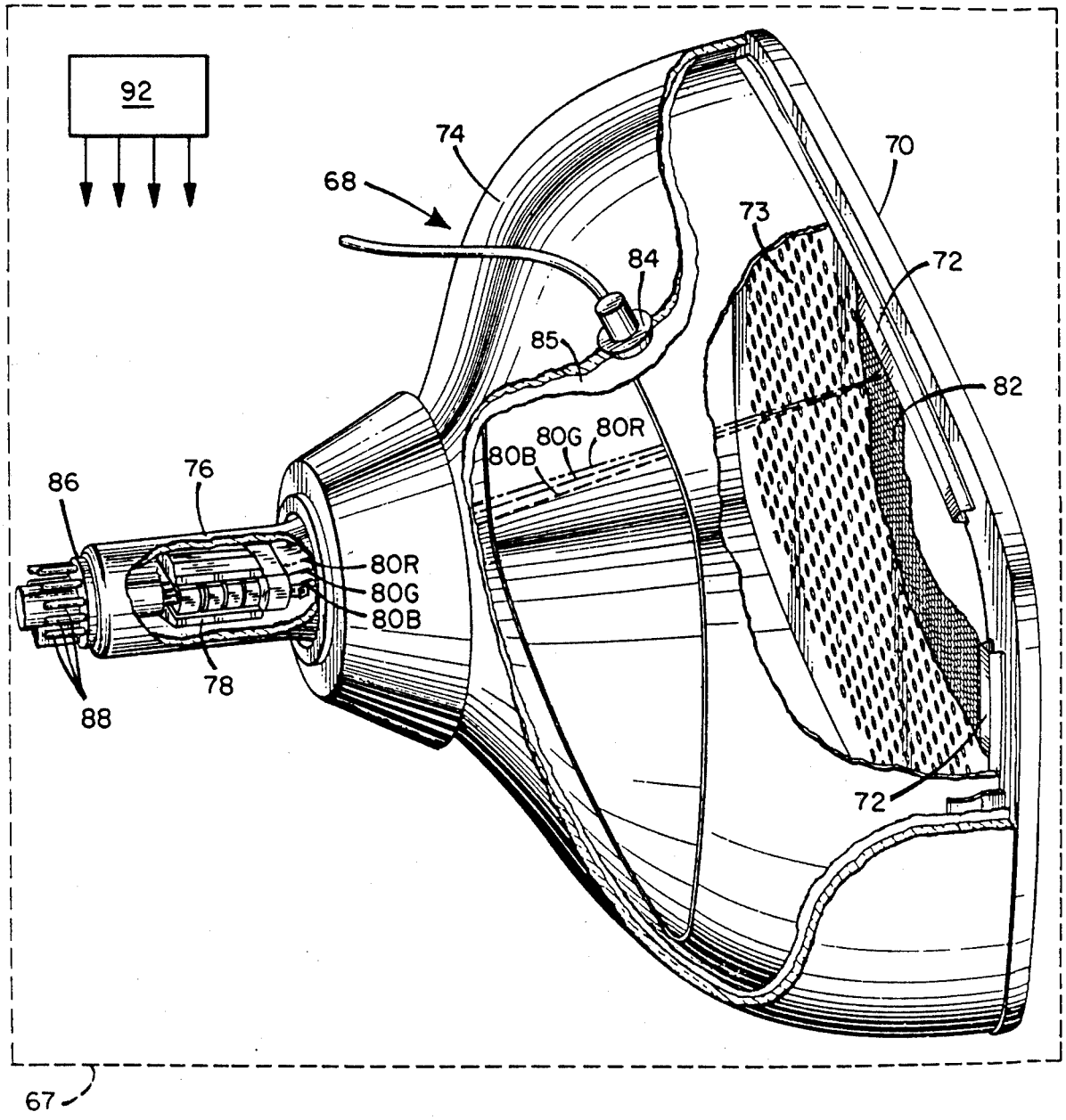
FIG. 4 is a view in elevation and partially in section of a cathode ray tube having a planar shadow mask and associated flat faceplate, with a television system or display system represented schematically by the enclosing dashed line, and in which the electron gun system according to the invention can be utilized.

A color cathode ray tube system according to the the present invention is depicted in FIG. 4. The system 67 is indicated in FIG. 4 as including a color cathode ray tube 68 with a substantially flat glass faceplate 70. A shadow mask support frame 72 is represented as being attached to faceplate 70 for supporting a shadow mask 73. Faceplate 70 is joined to a rear envelope section of tube 68, here shown as a funnel 74 which tapers down to a narrow neck 76. Neck 76 is shown as enclosing a three-beam, in-line electron gun 78 which is indicated as projecting three electron beams 80R, 80G, and 80B on to the inner surface of faceplate 70, comprising a phosphor screen 82. Screen 82 comprises a pattern of phosphor elements consisting of three compositions of phosphors deposited thereon which emit red, green and blue light when excited by the respective electron beams 80R, 80G, and 80B. An anode button 84, which is in contact with a conductive coating 85, provides for the entry into the tube envelope of a high electrical potential for tube operation. Relatively lower electrical potentials for operation of the electron gun 68 are conducted through the tube base 86 by means of a plurality of conductive pins 88. As shown by fgure 4, a Yoke means 90, noted as being a self-converging yoke, provides for deflecting the electron beams 80R, 80G and 80B across the screen 82 of faceplate 70 to selectively excite the phosphors deposited thereon through the foraminous medium of the shadow mask 73.

The three electron beams 80R, 80G and 80B of tube 74 are caused to scan a raster on the respective phosphor deposits on screen 82. The beams are modulated; that is, the beam currents are varied to form the picture. Beam scanning is a product of horizontal and vertical scansion circuits by which scanning signals are applied to the yoke of the tube, all as is well known in the art.

The circuits that provide potentials for cathode activation, beam scanning, and beam luminance, and which form field components in the gaps between adjacent electrodes, are indicated schematically by block 92. As has been noted, the potentials are applied to the gun components by way of ones of the conductive pins 88. An ancillary circuit also provides the single dynamic signal required for control of the operating parameters of the electron gun, as will be described.

Figure 5:
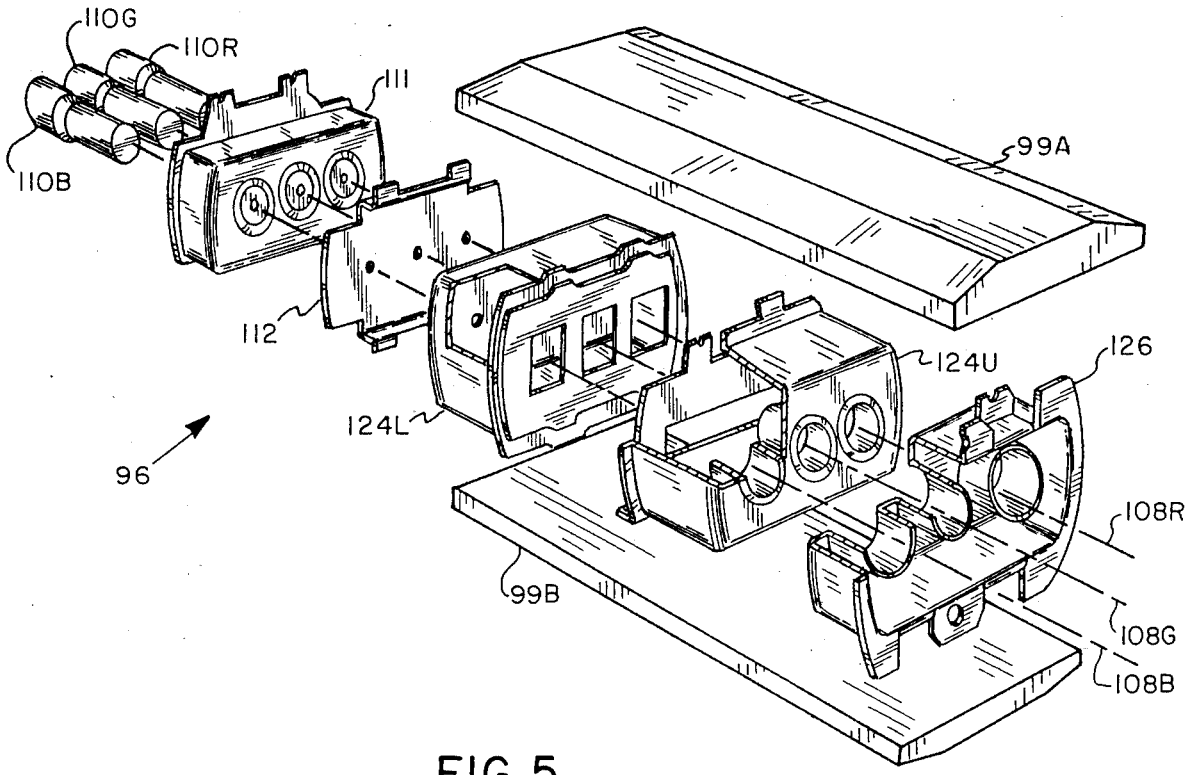
FIG. 5 is an exploded view in perspective and partially cut away that shows the relationship of the components of a three-beam electron gun according to the invention.
Figure 6:
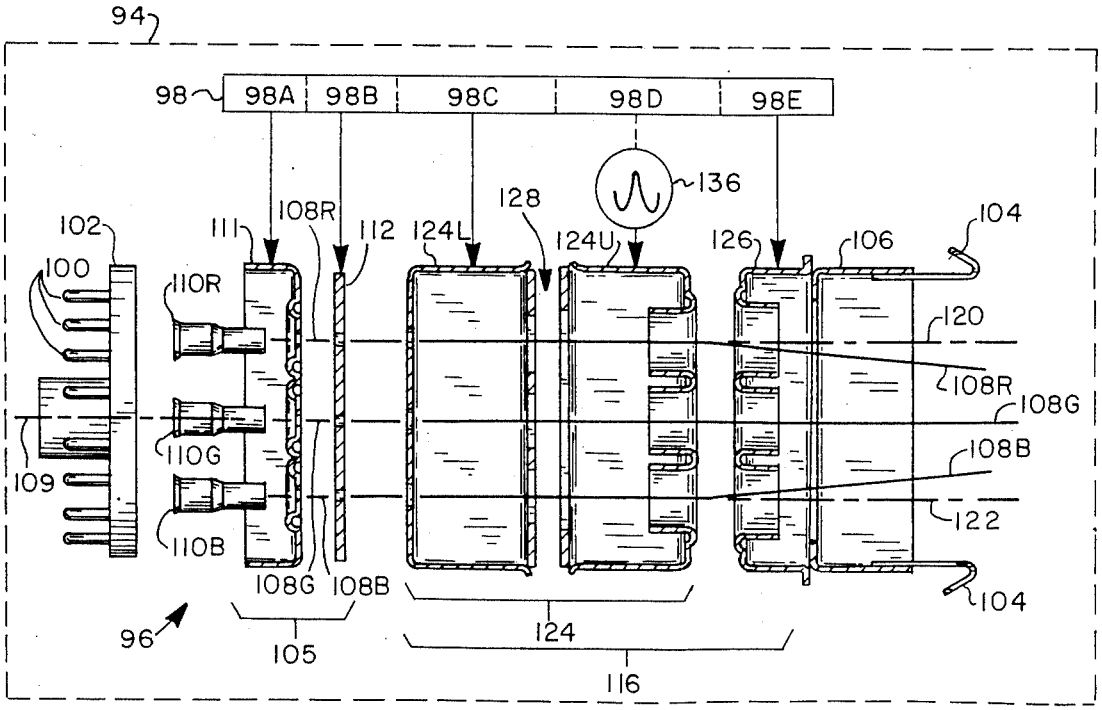
FIG. 6 is a schematized top view of the electron gun depicted in FIG. 5; the system aspect according to the invention is represented by the dash-line outline.
Figure 7:
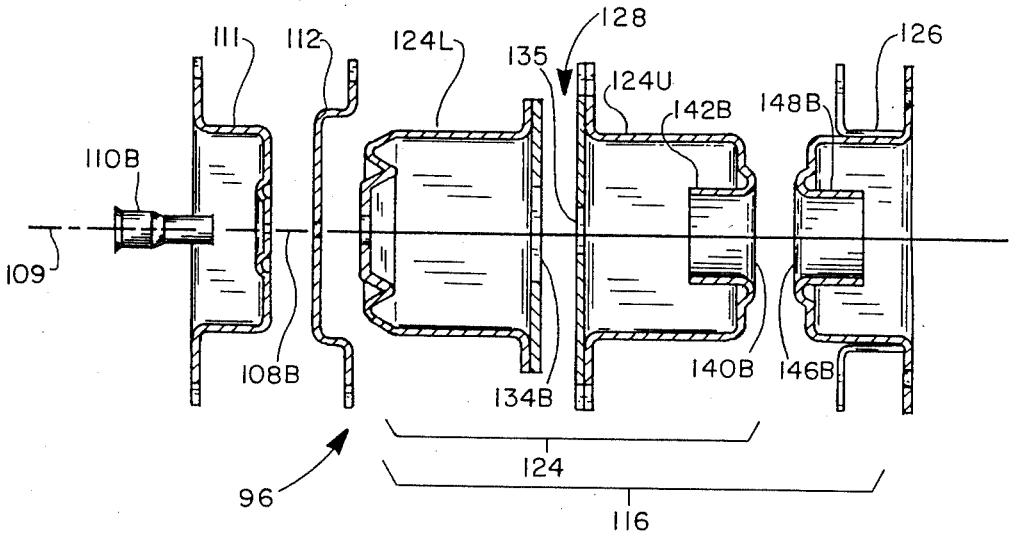
FIG. 7 is a side view in elevation of the electron gun depicted in FIGS. 5 and 6, with the electrodes show as exploded.

An electron gun that is part of a system that provides for control of convergence, focusing and astigmatism with a single dynamic signal according to the invention is depicted in FIGS. 5 and 6. The system 94 comprises an electron gun 96, and includes means 98 for developing and applying to the plurality of electrode means of each of the focus lens means potential which form one or more focusing field components between the electrode means. The means for developing the potentials are indicated schematically by the block 98. A plurality of electrode means for each beam, shown as being four electrodes in this example provide, among other benefits, for shaping and focusing the beams, and compensating for the inherent astigmatism in the gun and in the system. The electrodes are physically retained in precise relationship one with the other by glass multiforms 99A and 99B.

As noted, the potentials are normally conducted to the electrodes of gun 96 through selected ones of the electrically conductive pins 100 that pass in airtight seal through electrically insulative base 102 of tube 96. In the diagram of FIG. 6, however, the potentials are indicated for illustrative purpose as being conducted directly from means 98 directly to the electrodes. The very high potential (e.g., 20–30 kV) applied to the final, or "anode" electrode, is typically routed through the anode button (see Ref. No. 84 in FIG. 4) in the tute envelope to the conductive coating 85 on the inner surface of the funnel 74. The potential is then conducted to the final, anode electrode by a plurality of gun-centering springs 104, typically three in number, that make contact with the conductive coating, and which extend from a cup-shaped electrode 106, also known as a "convergence cup." Electrode 106 is normally physically and electrically attached to the final anode as by welding.

In the preferred embodiment of the invention, electron gun 96 has means including cathode means for developing three inline electron beams 108R, 108G and 108B. The three teams are shown as being projected in parallelism with the center axis 109 of gun 96 except when the two outer beams are caused to converge, as will be described. The means 105 for developing the three electron beams is commonly referred to as the "prefocusing section," which includes the three cathode means 110R, 110G and 110B, and electrode means 111 and 112 commonly referred to as the "control grid" and the "accelerating grid," respectively. The three beams are generated by thermionic emission of the cathode means, as is well known in the art.

Three focus lens means 116 provide for receiving the three in-line beams 108R, 108G and 108B for forming three focused electron beam spots at the screen of the tube. (A screen is indicated by reference number 72 in FIG. 4.) The focus lens means 116 each have a plurality of electrode means spaced along a lens axis parallel to the other lens axes and parallel to a gun center axis 109. At least two of the lens axes, shown as being two lens axes 120 and 122, are off-axis with respect to the gun central axis 109. Center beam 108G is noted as being in alignment with the gun center axis 109. Please note also that the term "focus lens means" refers to the focus lens structure employed to focus all the beams; this group of lens means bears reference number 116. The term "focus electrode means" refers to a discrete individual focus electrode for a single beam, or an allotted portion of a unitized electrode common to others of the beams. The focus lens means 116 depicted in FIGS. 5 and 6 is a two-element bipotential lens having a split focusing element, as will be described.

Focus lens means 116 is representd as including a focus electrode means 124, indicated as comprising a split electrode, and second electrode means 126 adjacent to focus electrode means 124 and at the "upper" end of the gun; that is, the end nearest the screen. Second electrode means 126 is also referred to as an "anode electrode" or "accelerating electrode," as it receives high voltage for beam acceleration through cup 106 and centering springs 104, as has been described.

Focusing electrode means 124, noted as being a split electrode, comprises two sections: a "lower" section 124L, and an "upper" section 124U. Although the two sections are electricaly isolated, they are very close together, and the inter-space 128 is typically about about 0.020 inch. It will be noted that the apertures of certain of the focus lens electrodes have novel rectangular shapes, and that others have inwardly extending beam-passing tubes, the purposes of which will be described.

Means are provided according to the invention for developing and applying to the focus lens means means 124L, 124U and 126 electrical potentials which form focusing field components between the electrode means. The off-axis focus lens means are so structured and arranged as to cause a focusing field component to be asymmetrical and effective to converge off-axis beams 108R and 108B. The means for developing and applying the potentials, indicated schematically by the block 98, provide the following typical, fixed voltage values—

| Block No. | Potential, V | Applied to Electrode |
|---|---|---|
| 98 A | 0 | 111 |
| 98 B | 700 | 112 |
| 98 C | 7,000 | 124 L |
| 98 D | 7,000 | 124 U |
| 98 E | 25,000 | 126 |

The potential applied to the electrode 124 is not truly fixed, but is adjustable both statically and dnamically according to the invention. With regard to static adjustment of the focusing potentials of 7,000 volts, the potentials are made manually variable in the range of ±400 volts e.g. for use in the manufacturing and servicing "set-up" process, in which the three beams are focused at the center of the screen. Once established, this potential is left unchanged unless further servicing is required.

Signal generating means according to the invention provide for developing a signal having amplitude variations correlated with a scan of the beams across the screen, and for applying the signal to the common structure electrode means; that is, to electrode 124. This signal is indicated by waveform 136, depicted as being being applied to electrode 124U. The effect of the signal is to simultaneously cause, as a function of beam deflection angle, (1) the strength of one or more focusing field components to weaken to produce a dynamic focusing effect, (2) the strength of the asymmetrical field component affecting the off-axis beams to weaken to produce a dynamic convergence effect, and (3) the strength of the quadrupole field to increase to produce a dynamic astigmatism-correcting effect. The signal may comprise a positive-going, variable voltage having an amplitude of 0 to 550 volts, by way of example. Details as to the origin and nature of this signal are described infra. Each of the focus lens means 124L and 124U include first and second electrostatic quadrupole-developing electrode means located in a substantially focus-fre region 126 therewithin and so configured and arranged as to develop a quadrupole field in the path of each of the beams when appropriately excited; that is, when a voltage difference is established therebetween. One of the quadrupole-developing electrode means, and one of the electrode means constituting the off-axis focus lens means constituting, at least in part, is termed a "common structure" electrode means.

Figure 8:
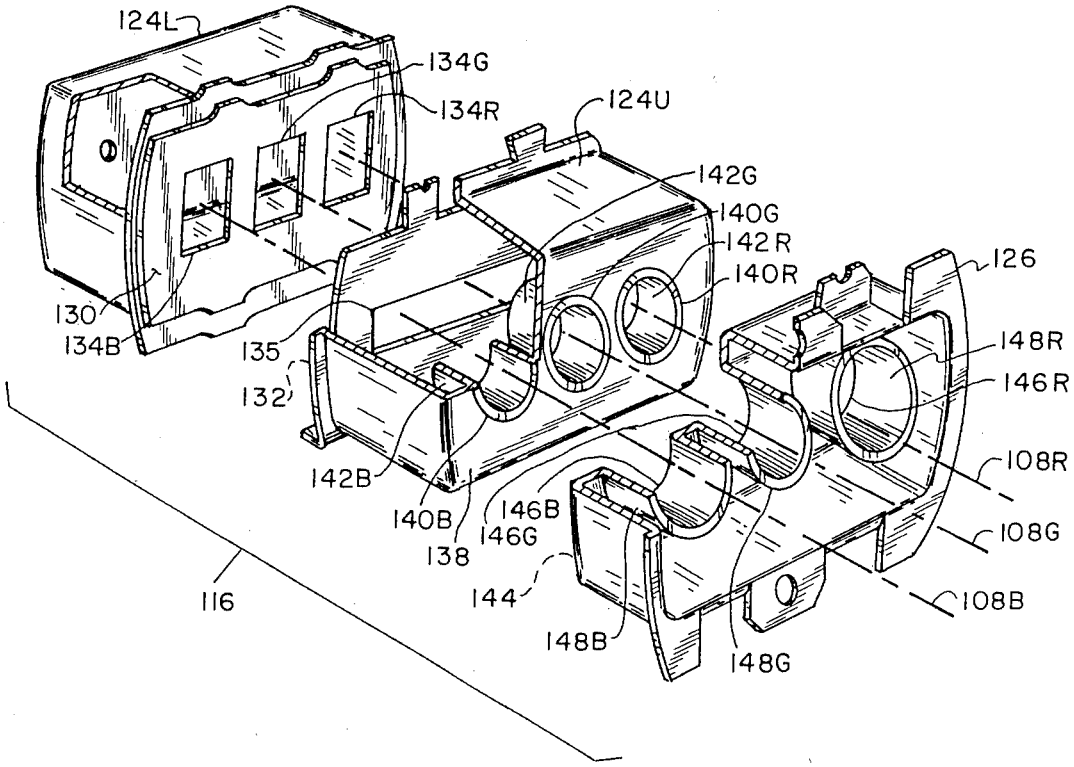
FIG. 8 is an enlarged cut-away view in perspective showing details of the focus lens section depicted in FIGS. 5, 6 and 7.

With reference to FIG. 8, which is an enlarged view of the focus lens means 116 depicted in FIG. 5, the quadrupole-developing means comprises first electrode means 124L and second, spaced electrode means 124U having first and second addressing faces 130 and 132, respectively. First addressing face 130 is depicted as having for each of the beam 108R, 108G and 108B a vertically rectangular aperture 134R, 134G and 134B. The dimensions of the slots may be, by way of example, 0.90 by 0.180 inch. Second addressing face 132 is indicated as having a single, unbroken, horizontally rectangular slit aperture 135 common to the three beams. Dimensions of the elongated slot may be 0.90 by 0.580 inch, by way of example.

The apertures of the gun system according to the invention in at least one of the electrodes means comprise internal cylinders effective to substantially eliminate the astigmatizing effects of the electrodes on the beams. Apertures 140R, 140G and 140B of electrode 124U are shown as having internal cylinders 142R, 142G, and 142B for the respective beams. Apertures 146R, 146G and 146B of electrode 126 are depicted as having respective internal cylinders 148R, 148G and 148B. Because of the internal cylinders, the gun system is substantially free of beam astigmatism when the beams are centered at the screen, and when the dynamic signal is at zero level.

Figure 9:
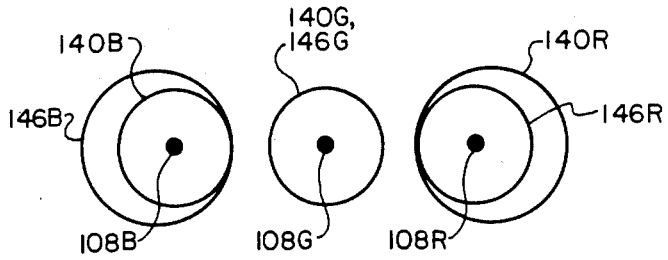
FIG. 9 is a diagrammatic, superimposed view of the electron gun apertures of the two electrodes nearest the screen as seen from the screen.

As noted, each of the off-axis focus lens means are so structured and arranged according to the invention as to cause a focusing field component to be asymmetrical and effective to converge the off-axis beams 108R and 108B. One means for providing the asymmetry is indicated in FIG. 9, which shows the relative size and relative positions of the apertures in the facing surfaces 138 and 144 of electrodes 124U and 126. With regard to the center beam 108G, the apertures for passing the beam--aperture 140G located in electrode 124U, and aperture 146G located in electrode 126, are represented as being of the same diameter and concentric. The apertures for the two off-axis beams 108R and 108B, however, are shown as being of different diameter and not concentric. With regard to the beam-passing apertures for beam 108R, aperture 146R located in electrode 126 is shown as being greater in diameter than aperture 140R in electrode 124U, and offset horizontally therefrom. Ihe same condition applies to the apertures for passing beam 108B, wherein aperture 146B in electrode 126 is depicted as being greater in diameter and offset horizontally from aperture 140B in electrode 124U. The effect of aperture asymmetry is indicated by FIG. 6, wherein off-axis beams 108R and 108B are shown as being diverged from respective axes 120 and 122 to follow converging paths.

Figure 10:
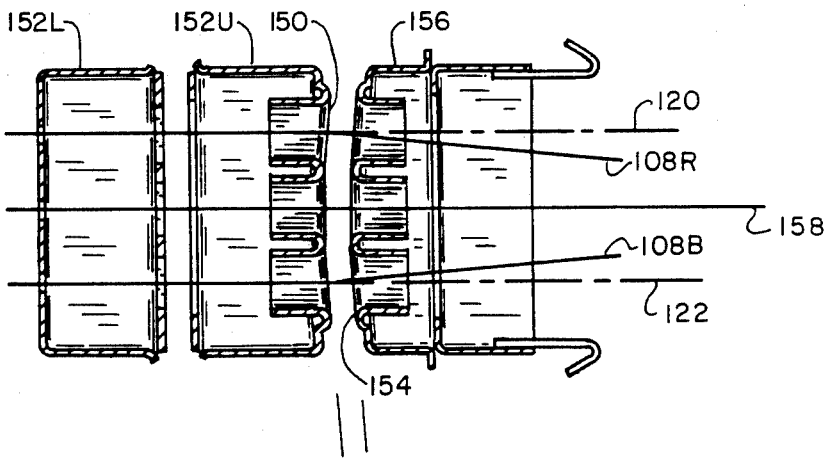
FIG. 10 is a schematized top view of another embodiment of means of beam convergence in an electron gun according to the invention.

Another means for providing an asymmetric field for achieving beam convergence is depicted in FIG. 10, where the facing surface 150 of electrode 152U, and the facig surface 154 of electrode 156 are shown as being parallel and angled relative to the central axis 158 of the gun so as to create the desired asymmetries of the focusing fields through which the off-axis beams pass and effective to statically converge the off-axis beams. As has been noted, the cup-shaped electrode with the centering springs is normally welded directly to the adjacent electrode, which is electrode 156 in this delineation.

The effect of the single dynamic signal in achieving control of convergence, atigmatism and focus according to the invention is described as follows. First with regard to the dynamic focusing effect: Electrode 124, indicated by the bracket in FIG. 6, functions as a focusing electrode. And although the electrode is split into a lower section 124L and an upper section 124U, the signal applied to the upper section 124U is effective to dynamically focus the three beams 108R, 108G and 108B all over the screen. Secondly, with regard to the dynamic corvergence effect and with reference to FIG. 10: the asymmetries in the focusing field component created by the electrode configurations in which the addressing faces of the off-axis electrodes are parallel and angled relative to the central axis 109 provide, in conjunction with the dynamic signal, for the convergence of the off-axis beams 108R and 108B at all points on the screen. The asymmetries can as well be created, again in conjunction with the dynamic signal, by the offsetting and enlargement of apertures 146R and 146B of accelerating electrode with respect to the apertures in the facing electrode, an aperture configuration that is depicted schematically in FIG. 9. Third, with regard to the control of dynamic astigmatism: As has been noted, the self-converging yoke astigmatizes the beams, the effect of which is indicated schematically by FIGS. 3 and 3A. With reference to FIGS. 5 and 8, electrodes 124L and 124U of focusing electrode 124 comprise according to the invention first and second quadrupole-developing electrode means ocated in a substantially focus-field-free region 128. As has been described, the configuration and arrangement of the apertures is sueh as to develop a quadrupole field in the path of each of the beams when a voltage difference is established therebetween. When the voltage difference is zero, there is no astigmatizing effect on the beams, but as the voltage difference is increased in consonance with the excursion of the beams across the screen, the quadrupolar field increases to counter the proportiorately increasing quadrupolar field produced by the self-corverging yoke.

As a result of the three-fold effect according to the invention, control of convergence, astigmatism and focus is accomplished with a single dynamic signal.

As has been described, the capabilities of existing self-converging yokes to provide convergence all over the screen without inducing inordinate beam astigmatism has been strained to the limit in conventional tube systems having curved faceplates. With the advent of flat faceplate tubes, present self-converging yoke designs are unable to provide satisfactory self-convergence at the screen edges without unacceptable degradation of the beam spot and shape in those regions. By the provision of the present invention, the measure of dynamic convergence which is achieved as an intended byproduct of the application of a dynamic focusing voltage to the focus electrode is such as to reduce the convergence demands on the yoke to the point where existing self-converging yokes can provide acceptable convergence at all points on the screen. The asymmetric field components have such polarity and strength due to the structuring and arranging of the electrodes, and the application of the dynamic signal, that a change in the level of the dynamic focus voltage causes a change in the strength of the asymmetric field components in a direction effective to deflect a common off-axis beam in a common angular direction. As a result, a strong dependence of the convergence of the off-axis beams on variations in the focus voltage is created, whereby a portion of the self convergence desired to be attained in the CRT system according to the invention is achieved by the converging of the beams as the beams are dynamically focused. The self-convergence demands on the yoke are thereby reduced.

Figure 11:
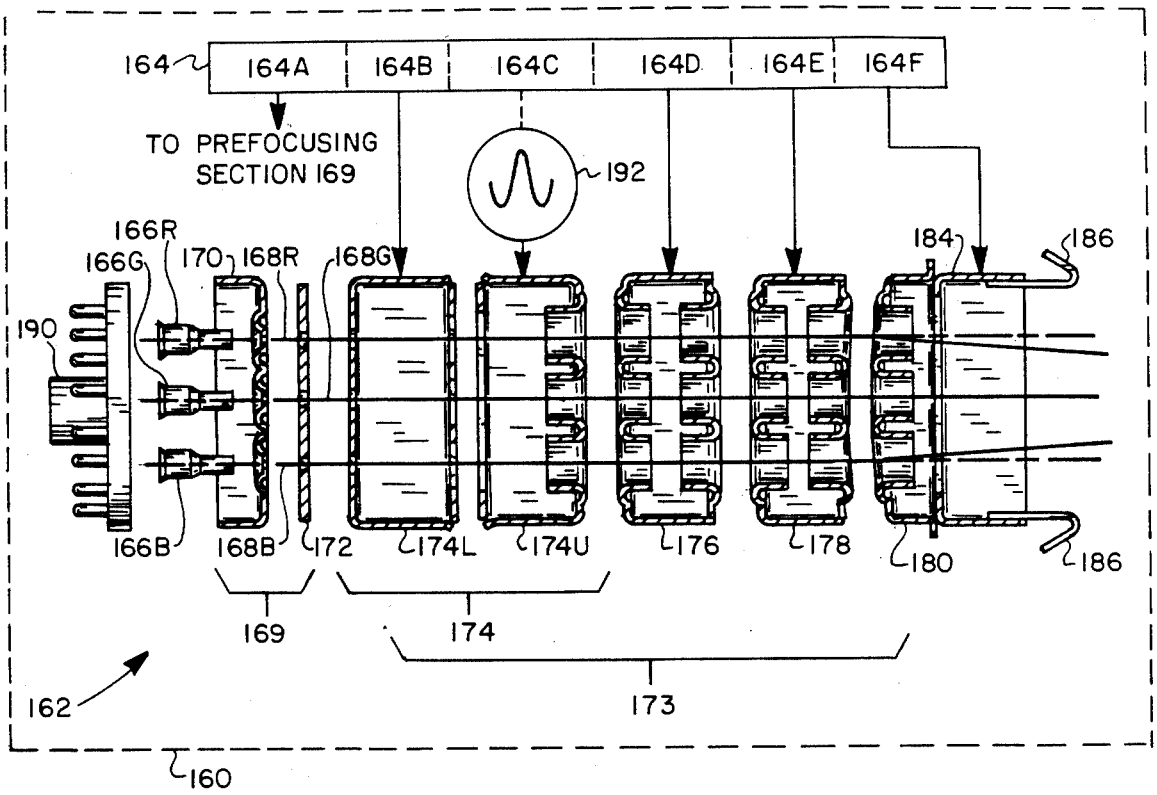
FIG. 11 is a schematized top view of an electron gun according to the invention having an extended field focus lens means.

FIG. 11 depicts an electron gun system 160 according to the invention that utilizes the principles of the extended field lens gun described and claimed in referent U.S. Pat. Nos. 3,995,194 and 4,058,753 to Blacker et al. As with the gun systems described heretofore, a system having a gun with an extended field lens can find useful application in both home entertainment television receiver systems and in monitors, and in tension mask cathode ray tubes. The gun system 160 described in following paragraphs is similar in inventive principles to the gun system 96 described heretofore, hence to avoid needless repetition, only the salient differences are described.

Gun system 160 basically comprises a seven-element, extended fie1d electron gun 162 and means for the supply of necessary voltages (indicated by the block 164) for gun operation as well as circuit means for producing the single dynamic signal that provides for control of convergence, astigmatism and focus according to the invention. Electron gun 162 has means including three cathode means 166R, 166G and 166B for developing three electron beams 168R, 168G and 168B. Prefocusing section 169 is indicated as including a control grid 170 and an accelerating grid 172. Gun 162 also includes four integrated (unitized) extended field focus lens means 173, indicated by the bracket, for focusing and converging the three beams 166R, 166G and 166B. The four electrodes of focus lens means 173 are depicted as comprising a first focusing electrode means 174 for receiving a focusing voltage for focusing the beams, and in succession downbeam, a second electrode means 176, and a third electrode means 178 followed by an accelerating electrode means 180. As has been noted heretofore, cup-shaped electrode 184 is normally welded to the adjacent electrode, which is accelerating electrode 180 in this gun configuration.

Focusing electrode means 174 will be noted as being a split electrode, and comprises two sections—a "lower" section 174L, and an "upper" section 174U. As with the electron gun systems described previously, focusing electrode means 174 comprises electrostatic quadrupole-developing means for developing a quadrupole field in the path of each of the beams when appropriately excited. It is to be noted that elements 174L and 174U of electrode 174 have aperture configurations identical to those of elements 124L and 124U, shown by FIG. 8.

The single dynamic signal that provides for control of convergence, astigmatism and focus depicted as being applied to section 1740 of electrode 174.

The off-axis focus lens means are each so structured and arranged as to cause at least one of the field components to be asymmetrical and effective to converge the off-axis beams at the screen. This asymmetry can be achieved by slanting the opposed faces of of electrodes 178 and 180 that pass the off-axis beams 166R and 166B; the faces are indicated as being parallel and angled relative to the central axis 190 of gun 162. This means of providing asymmetry is described in more detail in connection with FIG. 10. Another means for providing asymmetry comprises the forming of the off-axis apertures of the accelerating electrode to be larger and displaced outwardly—a structure described in detail in connection with FIG. 9.

Apertures in electrodes 174U, 176, 178 and 180 are depicted as having shielding means comprising internal cylinders effective to substantially eliminate the astigmatizing effects of the electrodes on the beams.

Means 164 for supplying operating voltages to the gun 162 include section 164A for supplying voltages to the prefocusing section 164. Sections 164B-164F provide for developing and applying to the respective electrodes 174L and 174U, 176, 178, and 180 of focus lens means 173 potentials which form focusing field components between the electrode means. Section 164F is represented schematically as supplying an operating potential to the anode electrode 180 through the centering springs 186 which are attached to cup 184, which in turn is attached physically and electrically to anode electrode 156.

Section 164C of the means 164 for developing and applying focus lens potentials provides, in addition to the potential which form field components in the gaps, a single dynamic signal 192 to electrode 174U. The signal 192, indicated highly schematically as being a parabolic waveform, is adapted to be correlated with the scan of the beams across the screen of the tube. Signal 192 according to the invention provides control of convergence, astigmatism and focus in gun 162 with the single dynamic signal 192.

The potentials, both fixed and varying, supplied by the means 136 to the unitized electrodes of the focus lens 148 may be as follows, by way of example:

| Voltage Supply Section | Supplied to | Voltages Supplied |
|---|---|---|
| 164 B | focusing electrode, section 174 L | 12 kV fixed |
| 164 C | focusing electrode, section 174 U | 12 kV fixed* |
| 164 D | electrode 176 | 7 kV fixed |
| 164 E | electrode 178 | 12 kV fixed |
| 164 F | electrode 180 | 27 kV fixed |

*Includes the single dynamic signal which may have an excursion of 0 to 500 volts, by way of example.

In company with other standard circuits for reproducing television signals, the application and operation of which are well known in the art, the electron gun system with control of convergence, astigmatism and focus with a single dynamic signal according to the invention has means for deriving the signal from horizontal and vertical scansion circuits, and deveoping a dynamic signal from them.

Monitor and television receiver systems in which the inventive concept can be advantageously employed comprise well-known types; as a result, details as to the best mode of implementation of the invention can be devoted to a simplified description of a suitable circuit for producing the single dynamic signal. Although similar in function, details of the types of components used, the specific circuit values, and the operating values of input and output signal voltages thereof will differ somewhat among the many brands of television receiver systems and monitors currently available. So a description of a basic functional circuit is supplied, the details of which can be readily provided and implemented by one skilled in the art in adapting basic video circuits to specific television receiver and monitor systems.

Figure 12:
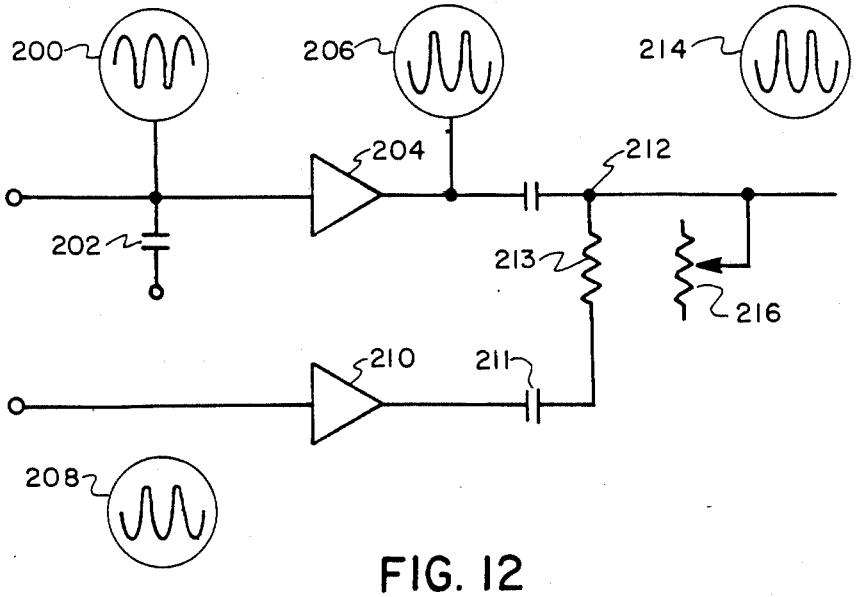
FIG. 12 is a schematic diagram of circuit means for forming a single signal for control of convergence, astigmatism and focus according to the invention.

The dynamic signal that provides for control of convergence, astigmatism and focus is essentially a combination of the parabolic waveforms developed by the horizontal and vertical sweep circuits of the television receiver (or monitor) system. With reference to FIG. 12, which indicates schematically a circuit for developing the dynamic signal, there is depicted a fast horizontal rate waveform 200 which provides for line scanning. This waveform can be taken by sampling the output of the "S" (sweep) capacitor 202 common to most television sweep circuits. Waveform 200 is in the form of a parabola; the frequency is typically 15 kHz. Amplifier stage 204 provides for amplification of this waveform to a higher voltage. The output waveform 206, shown as being an inverted parabola, has an amplitude of 500 volts, by way of example.

Waveform 208, also in the form of a parabola, represents the vertical rate waveform and is taken from a suitable point in the vertical sweep circuits. It provides for "flyback" of the scanning beams from the bottom of the screen to the top. It is a "slow" rate waveform, having a frequency of 60 Hz. The signal is amplified in amplifier 210 to about 500 volts. The outputs of both amplifiers are AC-coupled to the final output as indicated, with the combining taking place at point 212. Capacitor 211 provides for signal coupling, and resistor 213 provides for isolation. The composite signal waveform 214, which comprises the fast rate waveform superimposed on the slow rate waveform, provides for control of convergence, focusing and astigmatism with a single dynamic signal according to the invention. The signal is applied to a specified electrode of the focus lens; this electrode element has been designated in the foregoing account as an element of a split focusing electrode, as has been described; for example, the electrode 124U of focus electrode 124 depicted in FIG. 6. The voltage level of the composite signal is controlled by a resistive network 216, indicated highly schematically.

Figure 1:
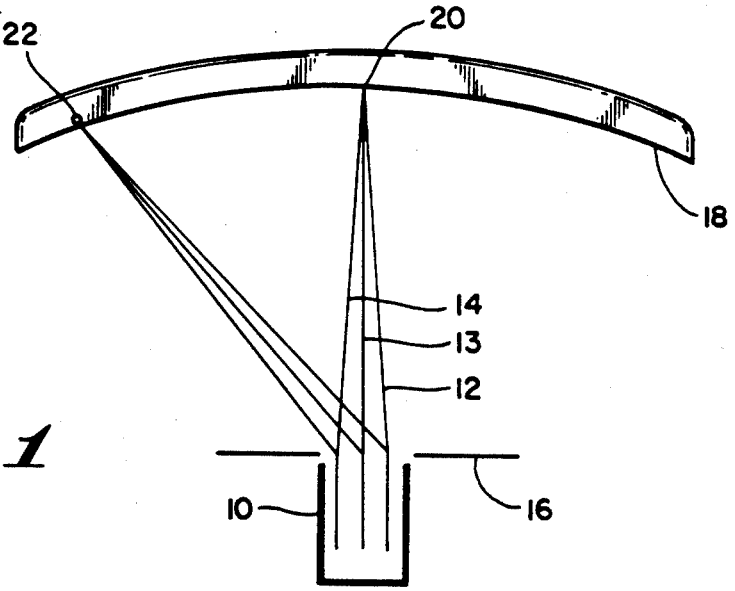
Fig. 1 PRIOR ART
FIG. 1 is a schematic representation of a desired effect of beam convergence on a curved cathode ray tube screen due to the dipolar convergence field components of the self-converging yoke.
Figure 2:
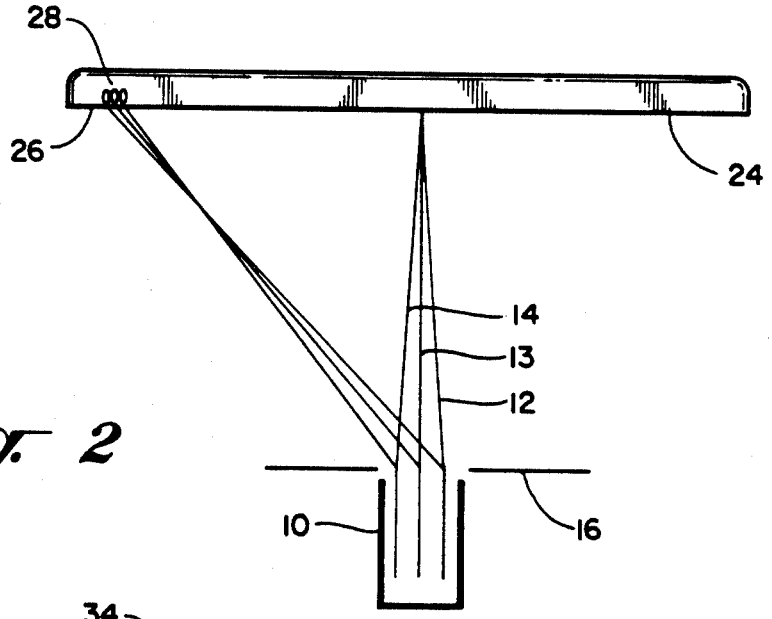
FIG. 2 depicts schematically the undesired effect of the self-converging yoke on beam convergence in peripheral areas of the screen of a cathode ray tube having a flat faceplate.
Figure 3:
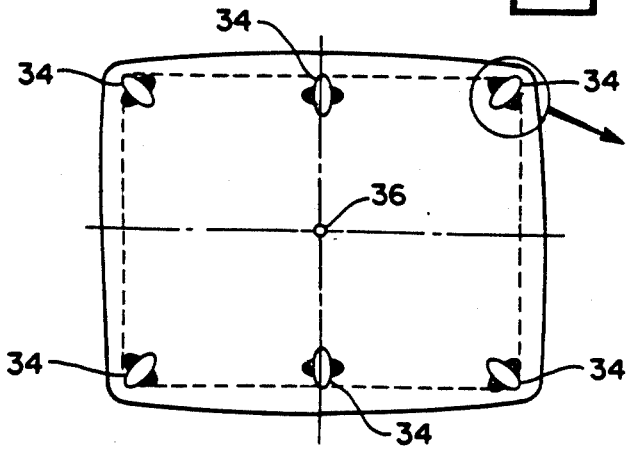
Fig. 3 PRIOR ART
FIG. 3 is a schematic representation of undesired beam spot configuratoon in corner areas of the screen of a flat faceplate attributable to the self-converging yoke.
Figure 3A:
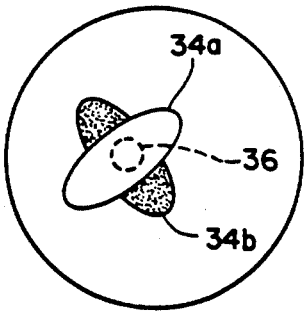
FIG. 3A is an enlarged view of the undesired beam spot configuration in the screen periphery indicated by FIG. 3.

The gun system according to the invention offers many benefits. For example, the effect of stigmatism attributed to the self-converging yoke as indicated by FIG. 3 is reduced by the means according to the invention. The system according to the invention also offers means for the elimination of convergence variations in vertical lines at the three and nine o'clock positions. Elimination is accomplished by adjusting the amplitude of the dynamic signal by circuit means. For example, potentiometer adjustments can be used to change waveshapes to accomplish convergence of the lines at three and nine o'clock. Another benefit is that dynamic convergence is controlled by the same waveform that controls focus and astigmatism.

A three-beam, in-line electron gun according to the invention for use in a color cathode ray tube having a phosphor screen comprises the means including cathode means for developing the three beams. Three focus lens means for provide for receiving the beams and forming three focused electron beam spots at the screen of the tube. The focus lens means each have a plurality of electrode means spaced being along a lens axis parallel to the other lens axes and parallel to a gun central axis. At least two of the lens axes and associated beams are off-axis with respect to the gun central axis. Electrostatic quadrupole-developing means comprise first electrode and second spaced electrode means having respective first and second addressing faces. The first face has for each beam a vertically rectangular aperture, and the second face has a single, unbroken, horizontally rectangular slit aperture common to the three beams. At least selected ones of the electrode means have off-axis lens axes so structured and arranged as to cause, when appropriately excited, field components formed therebetween to be asymmetric and effective to converge the off-axis beams.

At least one of the electrode means of the focus lens means of the gun according to the invention may have shielding means comprising internal cylinders effective to substantially eliminate any astigmatizing effect of the electrodes on the beams.

The system according to the invention makes possible the use of a self-converging yoke with a cathode ray tube having a planar shadow mask and a flat faceplate. Without the electron gun system according to the invention, the self-converging field of the yoke would have to be made stronger to attain beam convergence at the peripheries of the flat faceplate, but at the cost of an increase in distortion due to deflection defocusing. The self-converging electron gun system according to the invention provides for beam convergence even at the edges of the screen to reduce the self-convergence demands on the yoke.

A reduced strength of the non-uniform yoke field component may be achieved, resulting in a yoke of lesser aberration, and therefore lower cost. For example, if an $x^2+y^2$ focus waveform is employed, yoke aberration in the horizontal and vertical coils can then be reduced. On the other hand, if an $x^2$ focus waveform is employed, yoke aberration in the horizontal coil can then be reduced.

While particular embodiments of the invention have been shown and described, it will be readily apparent to those skilled in the art that changes and modifications may be made in the inventive means without departing from the invention in its broader aspects. For example, various embodiments have been described supra which illustrate the principles of the invention 15 as applicable to guns of many different types—bipotential, extended field, and even guns of the type wherein the first electrode in the focus lens has an intermediate potential, followed by a focus electrode receiving a lower potential, with the succeeding electrodes receive increasing potentials (the FIG. 11 embodiment). These embodiments show that a number of techniques can be used for creating the astigmatic condition and asymmetric field having strengths necessary to achieve the aforedescribed strong dependence of convergence on changes in focus voltage. The embodiments set forth illustrate that offset apertures may be employed as well as electrode gaps having angled plano-parallel orientations. The invention could equally be applied to embodiments using wedge-shaped gaps to create asymmetric fields. The polarity of the asymmetric fields, that is, the direction in which the fields cause the beam to deflect in order to achieve the objectives of the invention, is of course determined by whether the beam is decelerating or accelerating as it passes through an asymmetric field. The degree of offsetting of the apertures, or the angle of the plano-parallel gap faces or wedge face angles determines, for a given intervening field strength, the amount of beam deflection which will be produced by an asymmetrical field component. Other techniques may be devised in consonance with the inventive principles for causing the beam to bend to a greater or lesser degree in correspondence with changes in the focus voltage. The particular polarities of the asymmetric field at the electrode gaps specified by way of example will vary depending on the pattern of voltages applied to the electrodes and the mechanism used to cause beam divergence or deflection. However, what is important is that the geometry is such as to cause the beam at the asymmetric field to bend in a direction such as to augment the dependence of the system convergence on changes in focus voltage.

The aim of the appended claims is to cover all such changes and modifications as fall within the true spirit and scope of the invention.

We claim:

1. For use in a color cathode ray tube system having a color tube with a phosphor screen, the system comprising:

yoke means for deflecting said beams, said yoke means introducing a beam-astigmatizing quadrupole field;

a three-beam, in-line electron gun for exciting said screen, said gun including:

means including cathode means for developing said beams;

three focus lens means for receiving said electron beams and forming three focused electron beam spots at the screen of the tube, said focus lens means each having a plurality of electrode means spaced along a lens axis parallel to the other lens axes and parallel to a gun central axis, at least two of which lens axes are off-axis with respect to said gun central axis;

electrostatic quadrupole-developing means so configured and arranged as to develop a quadrupole field in the path of each of said beams when appropriately excited;

convergence means effective to converge the off-axis beams when appropriately excited;

means for developing and applying to said electrode means of each of said focus lens means potentials which form one or more field focusing components between said electrode means; and system signal generating means for developing a signal having amplitude variations correlated with a scan of the beams across the screen and for applying said signal to at least one of said electrode means, to said convergence means, and to said quadrupole-developing means to simultaneously cause, as a function of beam deflection angle, (1) the strength of said one or more focusing field components to weaken to produce a dynamic focusing effect, (2) the strength of said asymmetrical field component affecting said off-axis beams to weaken to produce a dynamic convergence effect, and (3), the strength of said quadrupole field to increase to produce a dynamic astigmatism-correction effect to compensate for the beam-astigmatizing effect of said yoke;

whereby the application of said signal, in addition to focusing all the beams and compensating for the astigmatizing effect of said yoke, provides an additional measure of beam convergence to reduce the self-convergence demands on the yoke, and whereby said gun system provides control of convergence, astigmatism and focus with a single dynamic signal.

2. The system defined by claim 1 wherein said electrostatic quadrupole-developing means comprises first electrode and second spaced electrode means having respective first and second addressing faces, said first face having for each beam a vertically rectangular aperture, and said second face having a single, unbroken, horizontally rectangular slit aperture common to said three beams, the application of said signals to said quadrupole-developing means causing a variable quadrupolar field to be developed between said first and second electrode means.

3. The gun system according to claim 2 wherein the apertures in at least one of said electrode means have shielding means comprising internal cylinders effective to substantially eliminate the astigmatizing effects of said electrodes on said beams, whereby said gun system is substantially free of beam astigmatism when said beams are centered at the screen and said dynamic signal is at zero level.

4. An electron gun system for use in a color cathode ray tube having a screen and comprising:

means including cathode means for developing three electron beams;

three focus lens means for receiving said electron beams and forming three focused electron beam spots at the screen of the tube, said focus lens means each having a plurality of electrode means spaced along a lens axis parallel to the other lens axes and parallel to a gun central axis, at least two of which lens axes are off-axis with respect to said gun central axis;

means for developing and applying to said electrode means of each of said focus lens means potentials which form one or more focusing field components between said electrode means;

said off-axis focus lens means each being so structured and arranged as to cause a focusing field component to be asymmetrical and effective to statically converge the off-axis beams;

said gun system including first and second quadrupole-developing electrode means so configured and arranged as to develop a quadrupolar field in the path of each of said beams when a voltage difference is established therebetween; and signal generating means for developing a signal having amplitude variations correlated with a scan of the beams across the screen and for applying said signal to at least one of said electrode means to simultaneously cause, as a function of beam angle, (1) the strength of said asymmetrical field component affecting said off-axis beams to weaken to produce a dynamic convergence effect, and (2), the strength of said quadrupolar field to increase to produce a dynamic astigmatism-quadrupolar correction effect.

5. The gun system defined by claim 4 wherein, said quadrupole-developing means comprises first electrode and second spaced electrode means having respective first and second addressing faces, said first face having for each beam a vertically rectangular aperture, and said second face having a single, unbroken, horizontally rectangular slit aperture common to said three beams, the application of said signals to said quadrupole-developing means causing a variable quadrupolar field to be developed between said first and second electrode means.

6. The gun system according to claim 5 wherein the apertures in at least one of said electrode means have shielding means comprising internal cylinders effective to substantially eliminate the astigmatizing effects of said electrodes on said beams, whereby said gun system is substantially free of beam astigmatism when said beams are centered at the screen and said dynamic signal is at zero level.

7. An electron gun system for use in a color cathode ray tube having a screen and comprising:

means including cathode means for developing three electron beams;

three focus lens means for receiving said electron beams and forming three focused electron beam spots at the screen of the tube, said focus lens means each having a plurality of electrode means spaced along a lens axis parallel to the other lens axes and parallel to a gun central axis, at least two of which lens axes are off-axis with respect to said gun central axis;

means for developing and applying to said electrode means of each of said focus lens means potentials which form one or more focusing field components between said electrode means;

said off-axis focus lens means each being so structured and arranged as to cause a focusing field component to be asymmetrical and effective to converge the off-axis beams;

said gun system including electrostatic quadrupole-developing means so configured and arranged as to develop a quadrupole field in the path of each of said beams when appropriately excited; and signal generating means for devloping a signal having amplitude variations correlated with a scan of the beams across the screen and for applying said signal to at least one of said electrode means to simultaneously cause, as a function of beam deflection angle, (1) the strength of said one or more focusing field components to weaken to produce a dynamic focusing effect, (2) the strength of said asymmetrical field component affecting said off-axis beams to weaken to produce a dynamic convergence effect, and (3) the strength of said quadrupolar field to increase to produce a dynamic astigmatism-correction effect;

whereby said gun system provides control of convergence, astigmatism and focus with a single dynamic signal.

8. The gun system defined by claim 7 wherein, said electrostatic quadrupole-developing means comprises first electrode means and second spaced electrode means having respective first and second addressing faces, said first face having for each beam a vertically rectangular aperture, and said second face having a single, unbroken, horizontally rectangular slit aperture common to said three beams, the application of said signals to said quadrupole-developing means causing a variable quadrupolar field to be developed between said first and second electrode means.

9. The gun system according to claim 8 wherein the apertures in at least one of said electrode means have shielding means comprising internal cylinders effective to substantially eliminate the astigmatizing effects of said electrodes on said beams, whereby said gun system is substantially free of beam astigmatism when said beams are centered at the screen and said dynamic signal is at zero level.

10. An electron gun system for use in a color cathode ray tube having a screen and comprising:

means including cathode means for developing three electron beams;

three focus lens means for receiving said electron beams and forming three focused electron beam spots at the screen of the tube, said focus lens means each having a plurality of electrode means spaced along a lens axis parallel to the other lens axes and paralel to a gun central axis, at least two of which lens axes are off-axis with respect to said gun central axis;

means for developing and applying to said electrode means of each of said focus lens means potentials which form one or more focusing field components between said electrode means;

said off-axis focus lens means each being so structured and arranged as to cause a focusing field component to be asymmetrical and effective to statically converge the off-axis beams;

said gun system including electrostatic quadrupole-developing means so configured and arranged as to develop a quadrupolar field in the path of each of said beams when appropriately excited; and signal-generating means for developing a signal having amplitude variations correlated with a scan of the beams across the screen and for applying said signal to at least one of said electrode means, to said convergence means and to said quadrupole-developing means to simultaneously cause, as a function of beam deflection angle, (1) the strength of said one or more focusing field components to weaken to produce a dynamic focusing effect, (2) the strength of said asymmetrical field component affecting said off-axis beams to weaken to produce a dynamic convergence effect, and (3), the strength of said quadrupolar field to increase to produce a dynamic astigmatism correction effect; whereby said gun system provides control of convergence, astigmatism and focus with a single dynamic signal.

11. The gun system defined by claim 10 wherein said electrostatic quadrupole-developing means comprises first electrode means and second spaced electrode means having respective first and second addressing faces, said first face having for each beam a vertically rectangular aperture, and said second face having a single, unbroken, horizontally rectangular slit aperture common to said three beams, the application of said signals to said quadrupole-developing means causing a variable quadrupolar field to be developed between said first and second electrode means.

12. The gun system according to claim 11 wherein the apertures in at least one of said electrode means have shielding means comprising internal cylinders effective to substantially eliminate the astigmatizing effects of said electrodes on said beams, whereby said gun system is substantially free of beam astigmatism when said beams are centered at the screen and said dynamic signal is at zero level.

13. An electron gun system for use in a color cathode ray tube having a screen and comprising:

means including cathode means for developing three electron beams;

three focus lens means for receiving said electron beams and forming three focused electron beam spots at the screen of the tube, said focus lens means each having a plurality of electrode means spaced along a lens axis parallel to the other lens axes and parallel to a gun central axis, at least two of which lens axes are off-axis with respect to said gun central axis;

means for developing and applying to said electrode means of each of said focus lens means potentials which form one or more focusing field coponents between said electrode means;

said off-axis focus lens means each being so structured and arranged as to cause a focusing field component to be asymmetrical and effective to converge the off-axis beams;

each of said focus lens means including first and second quadrupole-developing electrode means located in a substantialy focus-field-free region therewithin and so configured and arranged as to develop a quadrupolar field in the path of each of said beams when a voltage difference is established therebetween; and signal-generating means for developing a signal having amplitude variations correlated with a scan of the beams across the screen and for applying said signal to at least one of said electrode means to said convergence means, and to said quadrupole-developing means to simultaneously cause, as a function of beam deflection angle, (1) the strength of said one or more focusing field components to weaken to produce a dynamic focusing effect, (2) the strength of said asymmetrical field component affecting said off-axis beams to weaken to produce a dynamic convergence effect, and (3) the strength of said quadrupolar field to increase to produce a dynamic astigmatism-correction effect.

14. The gun system defined by claim 13 wherein said electrostatic quadrupole-developing means comprises first electrode and second spaced electrode means having respective first and second addressing faces, said first face having for each beam a vertically rectangular aperture, and said second face having a single, unbroken, horizontally rectangular slit aperture common to said three beams, the application of said signals to said quadrupole-developing means causing a variable quadrupolar field to be developed between said first and second electrode means.

15. The gun system according to claim 14 wherein the apertures in at least one of said electrode means have shielding means comprising internal cylinders effective to substantially eliminate the astigmatizing effects of said electrodes on said beams, whereby said gun system is substantially free of beam astigmatism said beams are centered at the screen and said dynamic signal is at zero level.

16. An electron gun system for use in a color cathode ray tube having a screen and comprising:

means including cathode means for developing three electron beams;

three focus lens means for receiving said electron beams and forming three focused electron beam spots at the screen of the tube, said focus lens means each having a plurality of electrode means spaced along a lens axis parallel to the other lens axes and parallel to a gun central axis, at least two of which lens axes are off-axis with respect to said gun central axis;

means for developing and applying to said electrode means of each of said focus lens means potentials which form one or more focusing field components between said electrode means;

said off-axis focus lens means each being so structured and arranged as to cause a focusing field component to be asymmetrical and effective to statically converge the off-axis beams;

each of said focus lens means including first and second quadrupole-developing electrode means located in a substantially focus-field-free region therewithin and so configured and arranged as to develop a quadrupolar field in the path of each of said beams when a voltage difference is established therebetween, one of said quadrupole-developing electrode means and one of the electrode means constituting said off-axis focus lens means constituting, at least in part, a common structure;

signal-generating means for developing signals having amplitude variations correlated with a scan of the beams across the screen and for applying said signals to said common structure electrode means to simultaneously cause, as a function of beam deflection angle, (1) the strength of said one or more focusing field components to weaken to produce a dynamic focusing effect, (2) the strength of said asymmetrical field component affecting said off-axis beams to weaken to produce a dynamic convergence effect, and (3) the strength of said quadrupolar field to increase to produce a dynamic astigmatism-correction effect.

17. The gun system defined by claim 16 wherein said electrostatic quadrupole-developing means comprises first electrode and second spaced electrode means having respective first and second addressing faces, said first face having for each beam a vertically rectangular aperture, and said second face having a single, unbroken, horizontally rectangular slit aperture common to said three beams, the application of said signals to said quadrupole-developing means causing a variable quadrupolar field to be developed between said first and second electrode means.

18. The gun system according to claim 17 wherein the apertures in at least one of said electrode means have shielding means comprising internal cylinders effective to substantially eliminate the astigmatizing effects of said electrodes on said beams, whereby said gun system is substantially free of beam astigmatism when said beams are centered at the screen and said dynamic signal is at zero level.

19. For use in an electron gun system for a color cathode ray tube having a screen, the method comprising:

developing three electron beams;

focusing said three electron beams at the screen of the tube, at least two of said beams having axes which are off axis with respect to a central beam axis;

developing an asymmetrical field in the path of each of said off-axis beams to cause said beams to be statically self-converged;

electrostatically developing a quadrupolar field in the path of each of said beams; and, developing a signal having amplitude variations correlated with a scan of the beams across the screen and for applying said signal to said gun system to simultaneously cause, as a function of beam deflection angle, (1) the strength of said asymmetrical field affecting said off-axis beams to weaken to produce a dynamic convergence effect, and (2) the strength of said quadrupolar field to increase to produce a dynamic astigmatism-correction effect.

20. For use in an electron gun system for a color cathode ray tube having a screen, the method comprising:

developing three electron beams;

developing focusing field components for focusing said three focused electron beams at the screen of the tube, at least two of said beams having axes which are off axis with respect to a central beam axis;

developing an asymmetrical field in the path of each of said off-axis beams to cause said off-axis beams to be statically self-converged;

electrostatically developing a quadrupolar field in the path of each of said beams; and developing a signal having amplitude variations correlated with a scan of the beams across the screen and for applying said signal to said gun system to simultaneously cause, as a function of beam angle deflection, (1) the strength of said one or more focusing field components to weaken to produce a dynamic focusing effect, (2) the strength of said asymmetrical field component affecting said off-axis beams to weaken to produce a dynamic convergence effect, and (3) the strength of said quadrupole field to increase to produce a dynamic astigmatism-correction effect, whereby said gun system provides control of said convergence, and control of astigmatism and focus with a single dynamic signal.

21. For use in a color cathode ray tube system having a color tube with a phosphor screen, a three-beam, in-line electron gun for exciting said screen, said gun comprising:

means including cathode means for developing said beams;

three focus lens means for receiving said electron beams and forming three focused electron beam spots at the screen of the tube, said focus lens means each having a plurality of electrode means spaced along a lens axis parallel to the other lens axes and parallel to a gun central axis, at least two of which lens axes are off-axis with respect to said gun central axis;

electrostatic quadrupole-developing means so configured and arranged as to develop a quadrupole field in the path of each of said beams when appropriately excited;

convergence means effective to converge the off-axis beams when appropriately excited;

22. The electron gun defined by claim 21 wherein said quadrupole-developing means comprises first electrode and second spaced electrode means having respective first and second addressing faces, said first face having for each beam a vertically rectangular aperture, and said second face having a single, unbroken, horizontally rectangular slit aperture common to said three beams, the application of said signals to said quadrupole-developing means causing a variable quadrupolar field to be develped between said first and second electrode means.

23. The gun system according to claim 22 wherein the apertures in at least one of said electrode means have shielding means comprising internal cylinders effective to substantially, eliminate the astigmatizing effects of said electrodes on said beams, whereby said gun system is substantially free of beam astigmatism when said beams are centered at the screen and said dynamic signal is at zero level.

24. A three-beam, in-line electron gun for use in a color cathode ray tube having a phosphor screen comprising:

means including cathode means for developing said three beams;

three focus lens means for receiving said beams and forming three focused electron beam spots at the screen of the tube, said focus lens means each having a plurality of electrode means spaced being along a lens axis parallel to the other lens axes and parallel to a gun central axis, at least two of which lens axes and associated beams are off-axis with respect to said gun central axis;

electrostatic quadrupole-developing means comprising first electrode and second spaced electrode means having respective first and second addressing faces, said first face having for each beam a vertically rectangular aperture, and said second face having a single, unbroken, horizontally rectangular slit aperture common to said three beams;

at least selected ones of said electrode means having off-axis lens axes being so structured and arranged as to cause, when appropriately excited, field components formed therebetween to be asymmetric and effective to converge said off-axis beams.

25. A three-beam, in-line electron gun for use in a color cathode ray tube having a phosphor screen comprising:

means including cathode means for developing said three beams;

three focus lens means for receiving said beams and forming three focused electron beam spots at the screen of the tube, said focus lens mean each having a plurality of electrode means spaced being along a lens axis parallel to the other lens axes and parallel to a gun central axis, at least two of which lens axes and associated beams are off-axis with respect to said gun central axis;

electrostatic quadrupole-developing means comprising first electrode and second spaced electrode means having respective first and second addressing faces, said first face having for each beam a vertically rectangular aperture, and said second face having a single, unbroken, horizontally rectangular slit aperture common to said three beams;

at least selected ones of said electrode means having off-axis lens axes being so structured and arranged as to cause, when appropriately excited, field components formed therebetween to be asymmetric and effective to converge said off-axis beams, at least one of said electrode means of said focus lens means having shielding means comprising internal cylinders effective to substantially eliminate any astigmatizing effect of said electrodes on said beams.

* * * * *